US007474871B2

(12) United States Patent
Fujiwara

(10) Patent No.: US 7,474,871 B2
(45) Date of Patent: Jan. 6, 2009

(54) PAPER SEPARATING MECHANISM OF FIXING DEVICE

(75) Inventor: Daisuke Fujiwara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 396 days.

(21) Appl. No.: 11/344,076

(22) Filed: Feb. 1, 2006

(65) Prior Publication Data

US 2007/0086814 A1 Apr. 19, 2007

(30) Foreign Application Priority Data

Oct. 14, 2005 (JP) ..... 2005-300174

(51) Int. Cl.
*G03G 15/20* (2006.01)

(52) U.S. Cl. ..... 399/323

(58) Field of Classification Search ..... 399/323, 399/320, 322, 68; 219/216, 469–471
See application file for complete search history.

(56) References Cited

U.S. PATENT DOCUMENTS

2004/0146322 A1* 7/2004 Lee ..... 399/323

FOREIGN PATENT DOCUMENTS

JP 10-333465 12/1998

* cited by examiner

*Primary Examiner*—Susan S Lee
(74) *Attorney, Agent, or Firm*—Smith, Gambrell & Russell, LLP

(57) ABSTRACT

Disclosed herein is a fixing device having a thermally fixing roller, a pressing belt mechanism and a separation member. An upper coupling member arranged between the side plates is provided with a side frame. The separation member includes a flat support plate, a first tilted flat plate and a second tilted flat plate. Both end regions of the second tilted flat plate form positioning protuberances, and the intermediate region forms a separation portion. The flat support plate is fixed to the side frame at a plurality of fixing portions by using screws. Ends of the positioning protuberances are brought into contact with the outer peripheral surfaces of the corresponding bearing members, and the end of the separation portion is positioned maintaining a predetermined gap with respect to the outer peripheral surface of the thermally fixing roller.

7 Claims, 6 Drawing Sheets

PAPER SEPARATING MECHANISM OF FIXING DEVICE

BACKGROUND OF THE INVENTION

1. Field of the Invention

The present invention relates to a fixing device arranged in an electrostatic electrophotographic image-forming machine such as a copier, a laser printer, a facsimile or the like. More particularly, the invention relates to a fixing device comprising a thermally fixing roller, pressing rotary means pressed onto the thermally fixing roller and a separation member for separating the paper from the outer peripheral surface of the thermally fixing roller.

2. Description of the Related Art

A fixing device mounted on an image-forming machine representatively comprises a thermally fixing roller, pressing rotary means such as a pressing roller that is brought into pressed contact with the thermally fixing roller, and a separation member for separating the paper from the outer peripheral surface of the thermally fixing roller. A toner image is fixed while a paper bearing the toner image transferred onto one surface thereof passes through a nipping portion between the thermally fixing roller and the pressing roller. The paper to which the toner image is fixed is discharged onto a paper discharge tray by a discharge roller.

The separation member is disposed to prevent jamming that may occur in case the papers wrap around the thermally fixing roller. The separation member representatively comprises separation pawls (see, for example, JP-A-10-333465). The separation pawls are brought into contact with the surface of the thermally fixing roller to effectively separate the paper that is going to wrap around the thermally fixing roller away from the thermally fixing roller. While the fixing is being conducted, however, the separation pawls are brought into contact with the surface of the thermally fixing roller giving rise to the occurrence of such inconveniences as an increased wear on the outer peripheral surface of the thermally fixing roller (usually, surface of an elastic layer made of a silicone rubber or the like) and scratches causing a decrease in the life of the fixing device and making it necessary to renew the fixing device at the time of regular maintenance of the image-forming machine.

SUMMARY OF THE INVENTION

It is an object of the present invention to provide a novel fixing device which prevents the occurrence of wear and scratches on the outer peripheral surface of the thermally fixing roller to assure the life of the fixing device despite of using a separation member for separating the paper from the outer peripheral surface of the thermally fixing roller.

According to the present invention, there is provided a fixing device comprising a pair of side wall means, coupling means extending between the side wall means, a thermally fixing roller rotatably supported between the side wall means on the inside of the coupling means, pressing rotary means pressed onto the thermally fixing roller, and a separation member for separating the paper from the outer peripheral surface of the thermally fixing roller;

wherein positioning means are arranged at both end regions of the thermally fixing roller, the positioning means having circular outer peripheral surfaces in concentric with the thermally fixing roller;

the coupling means extends straight between the side wall means, and includes a side frame having a flat outer surface;

the separation member includes a strip-like flat support plate extending straight in the lengthwise direction maintaining a predetermined width, a first tilted flat plate bent from one side of the flat support plate in the direction of width and is extending straight by a predetermined length, and a second tilted flat plate bent to the opposite side from the end of the first tilted flat plate and is extending straight, which are made of a piece of elastic metal plate, wherein both end regions of the second tilted flat plate in the lengthwise direction are forming positioning protuberances extending by the same length, and the intermediate region between the two end regions is forming a separation portion extending by a predetermined length which is shorter than the positioning protuberances; and the flat support plate of the separation member is fixed to the side frame by fixing means at a plurality of fixing portions provided on the flat support plate and on the side frame, which are brought in match with each other in a state where the flat support plate is overlapped on the outer surface of the side frame of the coupling means, and ends of the positioning protuberances are brought into contact with the outer peripheral surfaces of the corresponding positioning means in a state where the separation member is fixed to the side frame, so that the end of the separation portion is positioned maintaining a predetermined gap with respect to the outer peripheral surface of the thermally fixing roller.

It is desired that the flat support plate of the separation member has through slits formed therein being corresponded to the fixing portions, the through slits surrounding part of the regions that are surrounding the corresponding fixing portions.

It is desired that the through slits are formed for the corresponding fixing portions so as to be continuous over both side regions of the flat support plate in the lengthwise direction and over the region on the side of the first tilted flat plate.

It is desired that internally threaded holes are formed in the fixing portions in the side frame of the coupling means, mounting holes are formed in the fixing portions of the flat support plate of the separation member, the fixing means are made of fastening members, and the separation member is detachably fixed to the side frame of the coupling means by being fastened thereto by the fastening members through the mounting holes in the flat support plate of the separation member and through the internally threaded holes in the side frame of the coupling means, that are brought in match with each other in a state where the flat support plate is overlapped on the outer surface of the side frame.

It is desired that the separation member is made of a spring steel plate having a thickness equal to or less than 1.0 mm.

It is desired that the coupling means includes a metallic upper coupling plate member which extends straight between the upper regions of the side wall means and couples the upper regions together, and the side frame serves as a portion of the upper coupling plate member.

It is desired that the positioning means are made of bearing members for rotatably supporting the thermally fixing roller on the side wall means or are made of positioning portions disposed on the thermally fixing roller integrally therewith.

DETAILED DESCRIPTION OF PREFERRED EMBODIMENTS

Embodiments of the fixing device constituted according to the present invention will now be described in detail with reference to the accompanying drawings.

Figure 1:
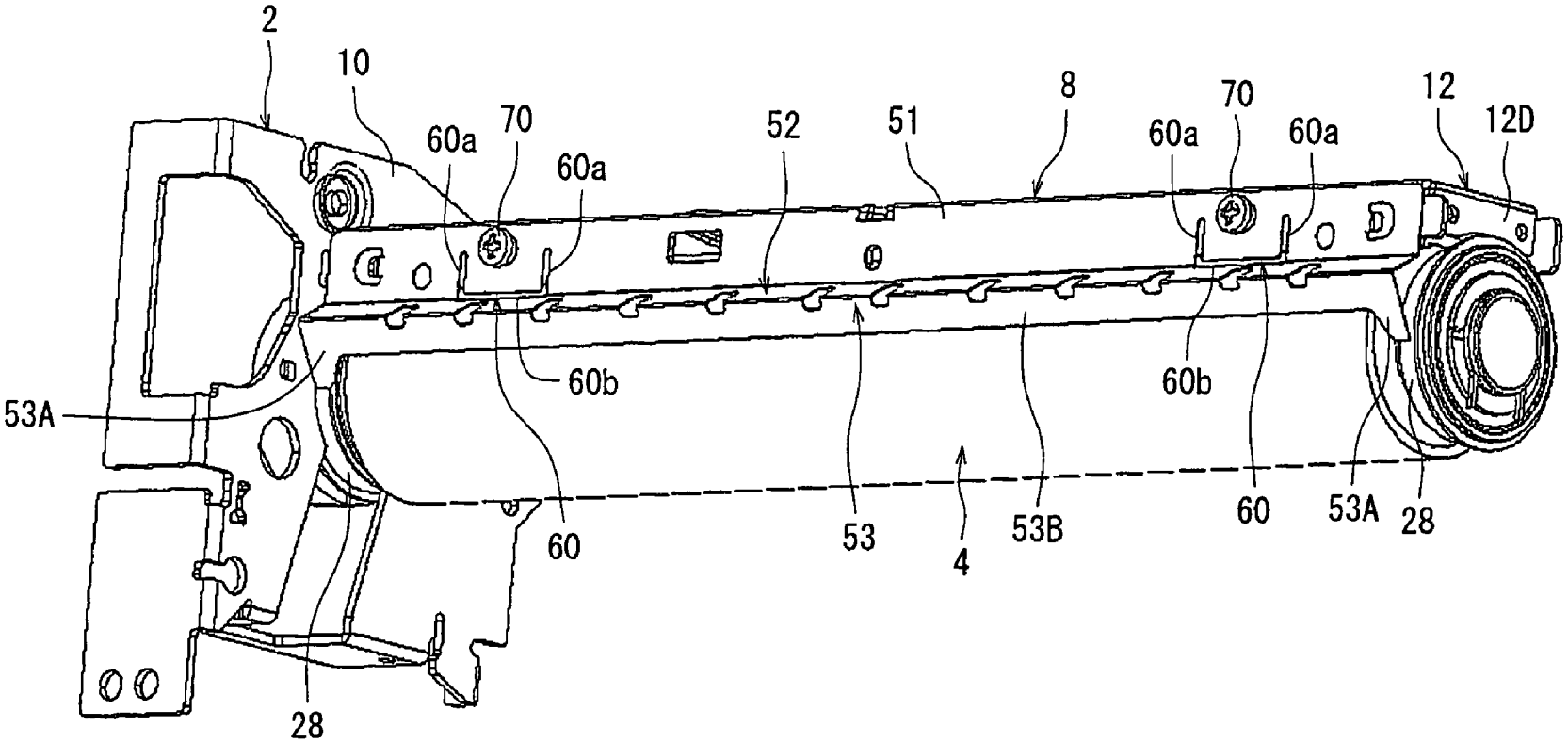
FIG. 1 is a perspective view illustrating major portions of an embodiment of a fixing device constituted according to the present invention.
Figure 2:
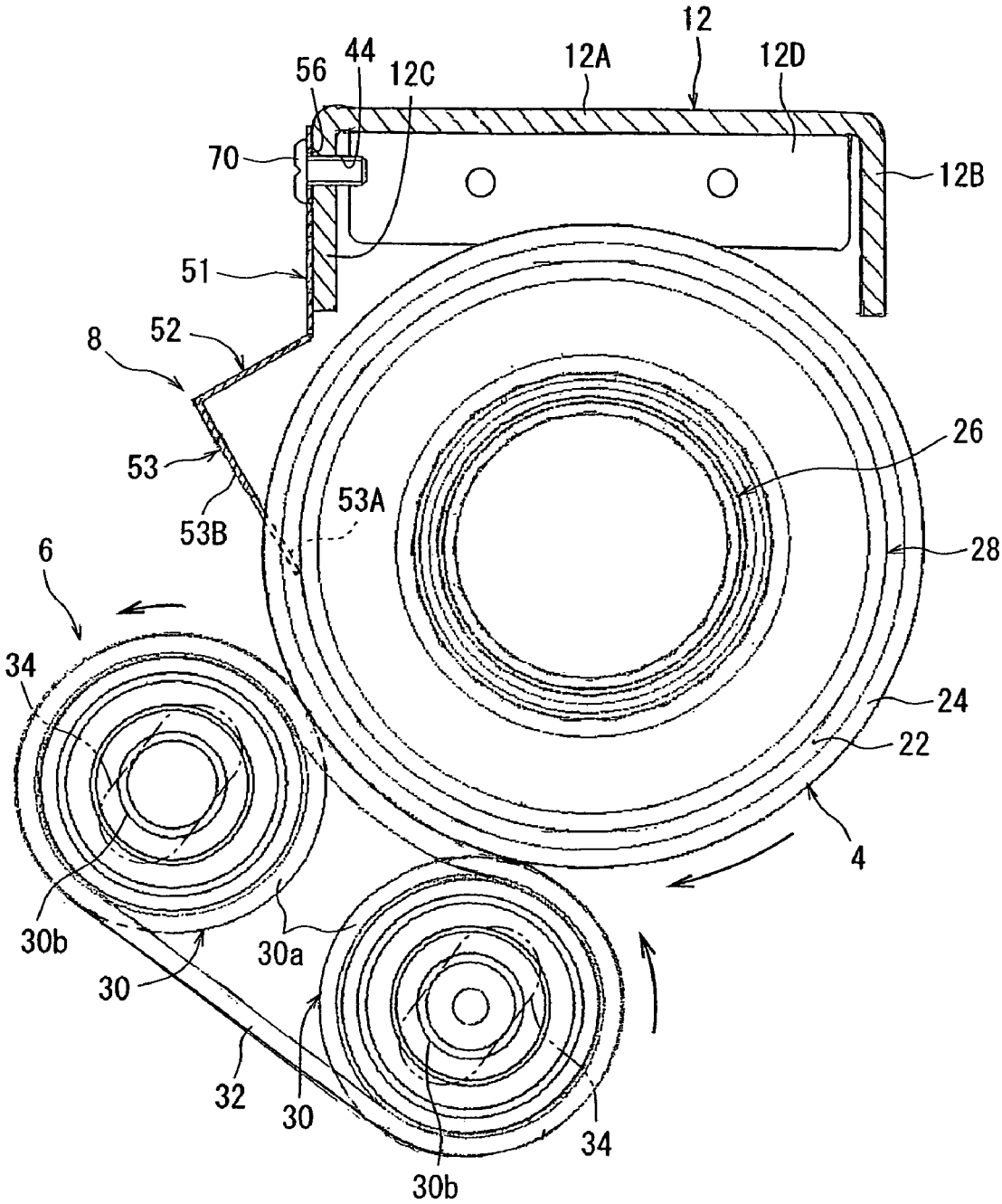
FIG. 2 is an enlarged transverse sectional view of the fixing device shown in FIG. 1 and, further, illustrates a pressing strip mechanism together therewith.
Figure 3:
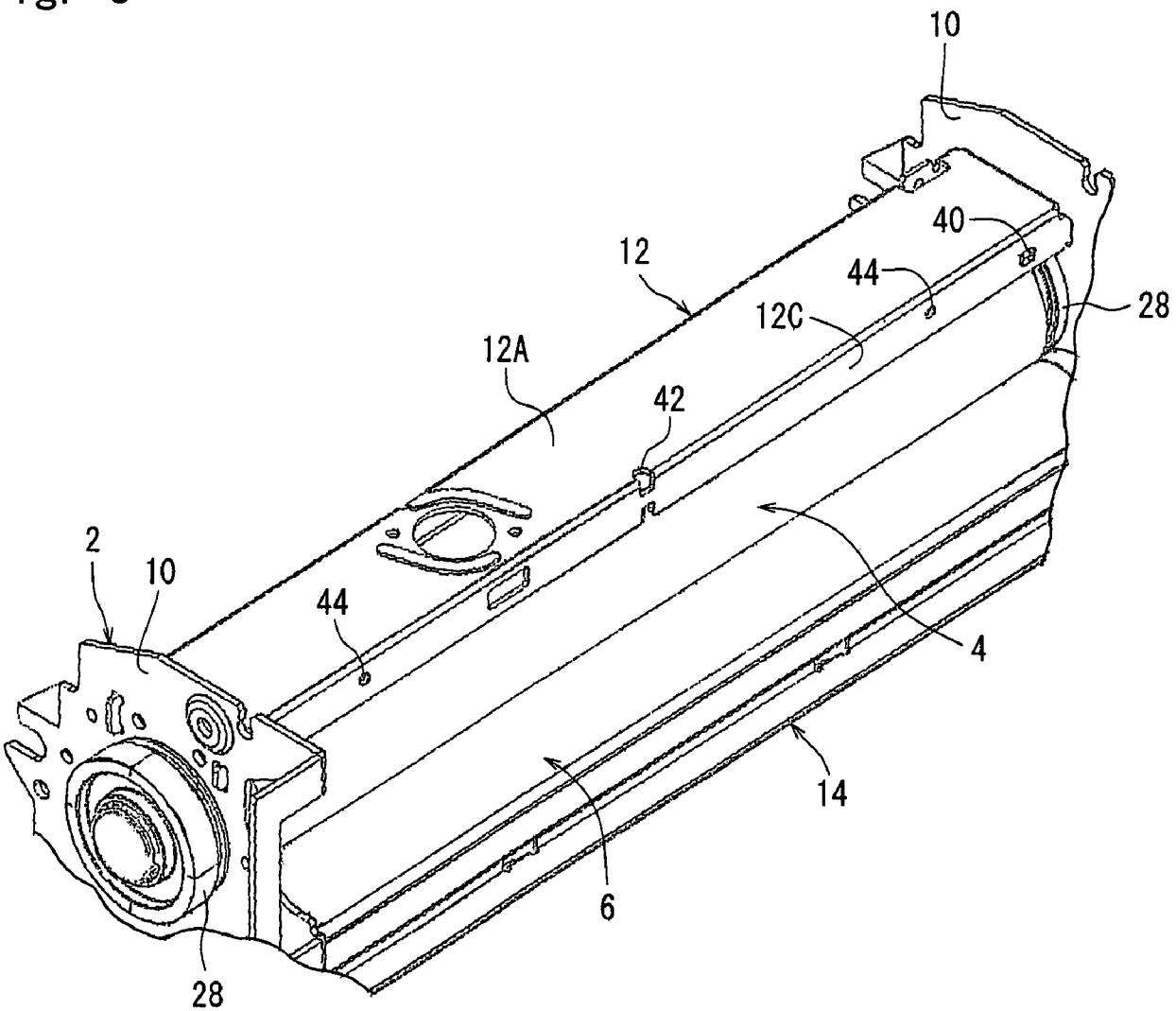
FIG. 3 is a perspective view of when the fixing device shown in FIG. 1 is seen from another angle, some members shown in FIG. 1 being omitted and some members that were not shown in FIG. 1 being added.

Referring to FIGS. 1 to 3, the fixing device includes a metallic frame body 2, a thermally fixing roller 4 supported by the frame body 2, a pressing belt mechanism 6 which is a pressing rotary means pressed onto the thermally fixing roller 4, and a separation member 8 for separating the paper from the outer peripheral surface of the thermally fixing roller 4.

The frame body 2 includes a pair of side plates 10 that constitute side wall means, and coupling means for coupling the side plates 10 in a manner to face each other and in parallel with each other maintaining a distance. The coupling means includes an upper coupling plate member 12 that extends straight between the upper regions of the side plates 10 to couple the upper regions together, an upstream lower coupling plate member (not shown) and a downstream lower coupling plate member 14 (FIG. 3), that extend straight between the lower regions of the side plates 10 to couple the lower regions together. The pair of side plates 10, the upper coupling plate member 12, upstream lower coupling plate member (not shown) and downstream lower coupling plate member 14, are made of metal plates, respectively. The upstream and the downstream stand for the upstream side and the downstream side in the direction in which the paper is conveyed, which in FIG. 2 is a direction heading aslant toward the left upper side from the right and in FIG. 3 is a direction generally heading toward the right from the left.

The upper coupling plate member 12 of the frame body 2 includes a top plate 12A which extends straight in the axial direction of the thermally fixing roller 4 (in a direction perpendicular to the surface of the paper in FIG. 2) maintaining a predetermined width (width in the right-and-left direction in FIG. 2), a pair of side frames (side plates) 12B and 12C hanging down from both sides of the top plate 12A in the direction of width, and a pair of end plates 12D (the end plate 12D of one side only is shown in FIGS. 1 and 2) hanging down from both ends of the top plate 12A in the axial direction. The upper coupling plate member 12 has the end plates 12D which are positioned facing the inner side surfaces of the corresponding side plates 10, and couples the upper regions of the side plates 10 together by being fastened thereto by using fastening members that are not shown. The top plate 12A of the upper coupling plate member 12 extends over the thermally fixing roller 4 in parallel with the axis of the thermally fixing roller 4. The outer surface (surface facing rightward in FIG. 2) of the side frame 12B and the outer surface (surface facing leftward in FIG. 2) of the side frame 12C are flat.

The thermally fixing roller 4 includes a cylindrical main body 22 made of a metal such as aluminum, and an elastic layer 24 made of a silicone rubber or the like arranged on the outer peripheral surface of the cylindrical main body 22. The thermally fixing roller 4 has shafts 26 formed integrally therewith so as to extend toward both sides in the axial direction from both ends of the cylindrical main body 22, the shafts 26 being rotatably supported at the central region of the corresponding side plates 10 via bearing members 28. Parts of the regions in the axial direction of the outer peripheral surfaces of the bearing members 28 constituted by, for example, radial ball bearings are exposed on the insides of the corresponding side plates 10. The bearing members 28 constitute positioning means having circular outer peripheral surfaces in concentric with the thermally fixing roller 4 and disposed at both end regions of the thermally fixing roller 4. A halogen heater (not shown) which is a heat source is arranged in the central portion of the thermally fixing roller 4. Both ends of the halogen heater are supported in a stationary state by the side covers (not shown) detachably mounted on the outer sides of the side plates 10.

The pressing belt mechanism 6 includes two support rollers 30 arranged on the outer side of the thermally fixing roller 4 in the radial direction maintaining a distance in the circumferential direction, and an endless belt 32 wrapped round the support rollers 30. Each support roller 30 includes a cylindrical main body 30*a* made of a metal such as SUS, and a shaft 30*b* extending from both ends of the cylindrical main body 30*a*, and is supported by elongated holes 34 formed in the corresponding side plates 10 so as to rotate relative thereto and to slide along the elongated holes 34. The elongated holes 34 are formed being extended in a direction to approach, and separate away from, the outer peripheral surface of the thermally fixing roller 4. When the thermally fixing roller 4 is seen in the axial direction, the elongated holes 34 are so formed as to extend along two imaginary straight lines (not shown) in parallel with an imaginary straight line (not shown) that passes through the axis of the thermally fixing roller 4.

Shafts 30*b* of the support rollers 30 are rotatably supported by bearing members (not shown) having semicircular bearing portions, and compression coil springs (not shown) are arranged between the bearing members and the corresponding side plates 10. The compression coil springs are pushing the corresponding bearing members toward the thermally fixing roller 4. When the thermally fixing roller 4 is viewed in the axial direction, the pushing direction of the compression coil springs is the one headed to the thermally fixing roller 4 along the above two imaginary lines in parallel with the above imaginary line that passes through the axis of the thermally fixing roller 4. Parts of the regions in the circumferential direction of the outer peripheral surfaces of the support rollers 30 are pushed onto parts of the regions in the circumferential direction of the outer peripheral surface of the thermally fixing roller 4 via the belt 32. Part of the region in the circumferential direction of the outer peripheral surface of the belt 32 is pushed onto part of the region in the circumferential direction of the outer peripheral surface of the thermally fixing roller 4. Upon suitably setting a distance between the elongated holes 34 or upon suitably setting a direction in which the elongated holes 34 extend, a desired tension is imparted to the belt 32. The belt 32 is made of a polyimide resin.

The thermally fixing roller 4 is drivably coupled to an electric motor through a power transmission mechanism inclusive of gears (none of them are shown). When the thermally fixing roller 4 is driven by the electric motor to rotate in the clockwise direction in FIG. 2, the belt 32 and the support rollers 30 are driven to rotate in the anti clockwise direction. The paper (not shown) having a toner image transferred onto one surface thereof is conveyed from the right toward the left in FIG. 2 through the nipping region between the belt 32 and the thermally fixing roller 4 to accomplish the fixing in a known manner.

In the upper coupling plate member 12, engaging holes 40 (FIG. 3 shows only one of them) elongated in the lengthwise direction are formed at both ends in the lengthwise direction (direction in which the side plates 10 are facing each other) of the side frame 12C positioned on the downstream side. The elongated engaging holes 40 having substantially the same constitution (in other words, having substantially the same shape and size) are extending in the lengthwise direction maintaining a predetermined width (width in a direction that meets the lengthwise direction at right angles). An engaging hole 42 is formed in a corner portion where the side frame 12C intersects the top plate 12A, the corner portion being located at the center in the lengthwise direction. The engaging hole 42 is formed extending across the side plate 12C and the top plate 12A and maintaining a predetermined width in the lengthwise direction. Internally threaded holes 44 are formed in the side frame 12C at positions on the inside of the elongated engaging holes 40 in the lengthwise direction. The internally threaded holes 44 and the regions surrounding the internally threaded holes 44 constitute fixing portions of the side frame 12C. Constitutions of the upstream lower coupling plate member and of the downstream lower coupling plate member 14 have no direct relationship to the present invention, and are not described here.

Figure 4:
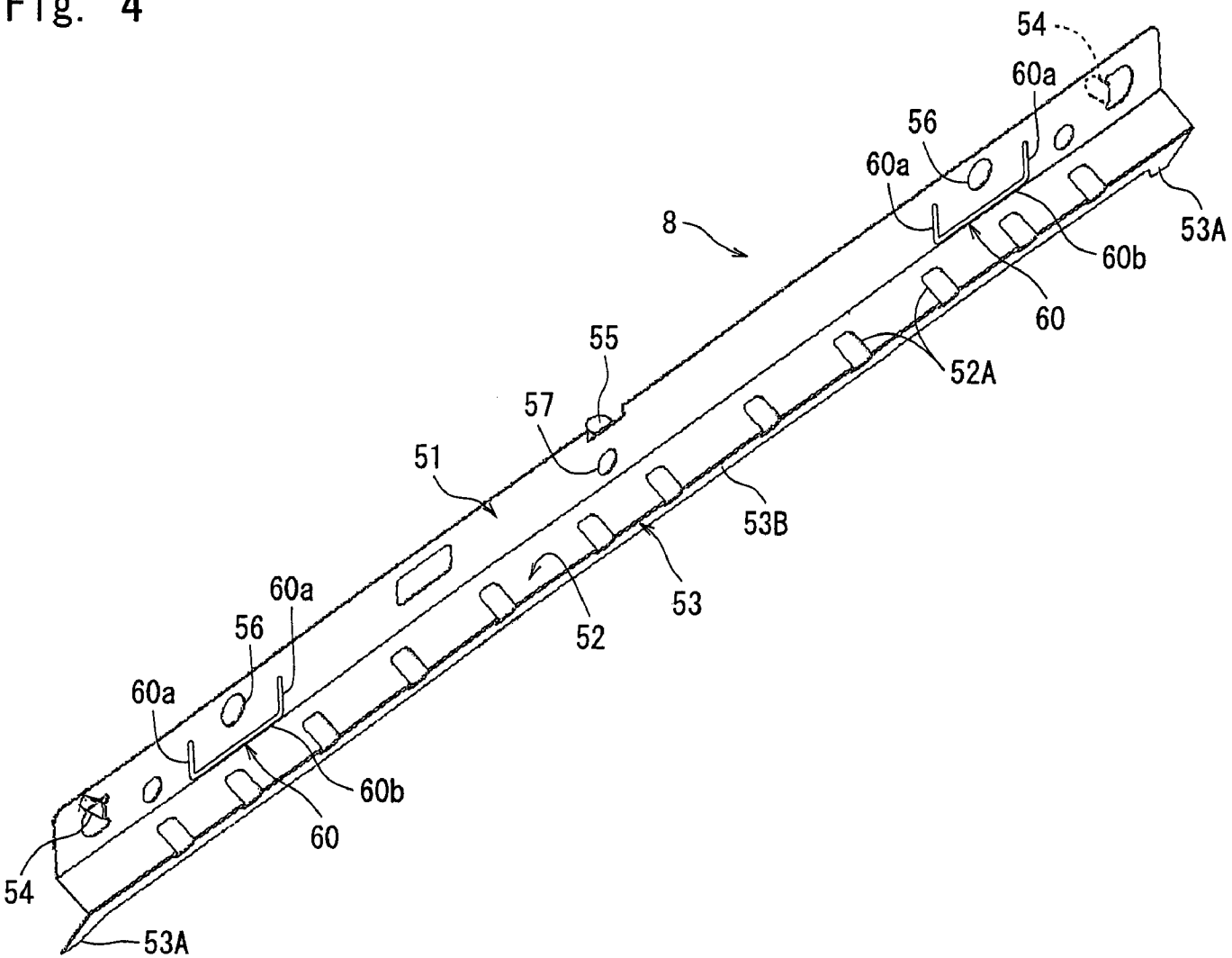
FIG. 4 is a perspective view illustrating, on an enlarged scale, a separation member provided in the fixing device shown in FIG. 1.
Figure 5:
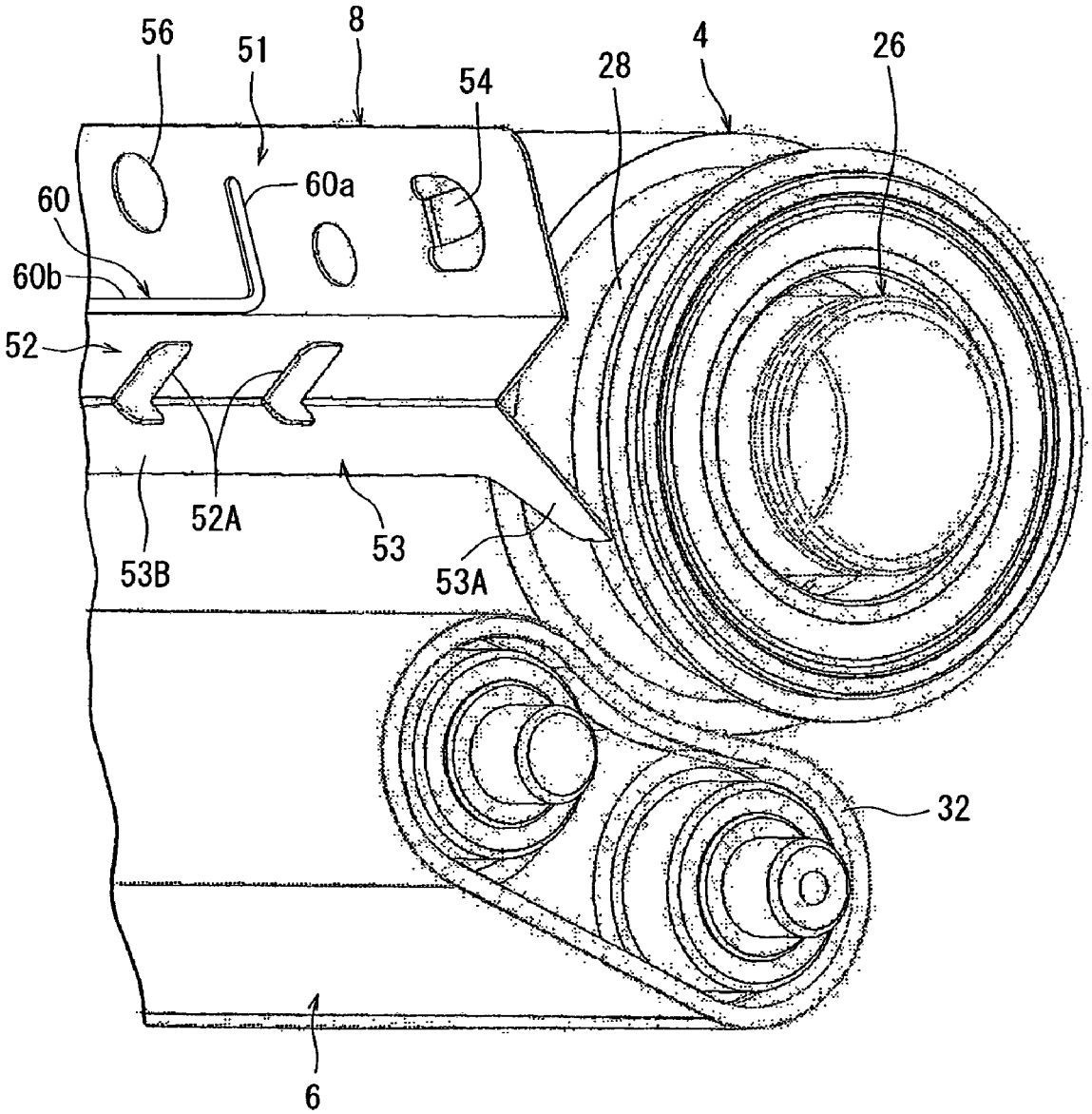
FIG. 5 is a perspective view of the fixing device shown in FIG. 1 and illustrates, on an enlarged scale, a right end portion of FIG. 1 together with the pressing strip mechanism.

Referring to FIGS. 1, 2 and 4, the separation member 8 is made of apiece of elastic metal plate or, in this embodiment, a piece of SUS (or more specifically, SUS304-CSP-H specified under the JIS) as a unitary structure, and includes the flat support plate 51, the first tilted flat plate 52 and the second tilted flat plate 53.

The flat support plate 51 is in the form of a strip extending straight in the lengthwise direction maintaining a predetermined width or, in other words, in a slender rectangular shape. The first tilted flat plate 52 is bent to the side of one surface from one side of the flat support plate 51 in the direction of width at a given angle (nearly 120 degrees in the embodiment), extends straight by a predetermined length, and assumes the shape of a strip as a whole. The second tilted flat plate 53 is bent to the opposite side from the end of the first tilted flat plate 52 at a given angle (nearly 90 degrees), extends straight, and assumes the shape of a strip except both end regions thereof in the lengthwise direction. In the second tilted flat plate 53, both end regions in the lengthwise direction form positioning protuberances 53A extending by the same length. The intermediate region between the two end regions is forming a separation portion 53B extending by a predetermined length which is shorter than the positioning protuberances 53A. The first tilted flat plate 52 is forming a plurality of notches 52A maintaining a distance in the lengthwise direction. The notches 52A are substantially of a rectangular shape, and their ends are formed spanning across the upper end of the separation portion 53B. The notches 52A are formed having reasons which are not directly related to the present invention and, hence, their function is not described here.

To-be-engaged tongue pieces 54 are formed at both ends in the lengthwise direction of the flat support plate 51 so as to extend from the surface of the back side (from the surface opposite to the surface of the front side from where the first tilted flat plate 52 is extending) at right angles with the surface of the back side maintaining a predetermined width (width in the direction at right angles with the lengthwise direction). The to-be-engaged tongue pieces 54 are formed being corresponded to the elongated engaging holes 40 (FIG. 3) formed in the side frame 12C of the upper coupling plate member 12. A to-be-engaged tongue piece 55 is formed at the central portion in the lengthwise direction of the flat support plate 51 so as to extend from the surface of the back side at right angles with the surface of the back side maintaining a predetermined width in the lengthwise direction. The to-be-engaged tongue piece 55 is formed being corresponded to the engaging hole 42 (FIG. 3) formed in the side plate 12C of the upper coupling plate member 12. Mounting holes 56 are formed in the flat support plate 51 at both ends closer to the center than the positions where the to-be-engaged tongue pieces 54 are formed in the lengthwise direction. The mounting holes 56 are formed being corresponded to the internally threaded holes 44 (FIG. 3) formed in the side frame 12C of the upper coupling plate member 12. Fixing portions of the flat support plate 51 are formed surrounding the mounting holes 56 and surrounding the regions of the mounting holes 56.

Referring to FIGS. 1 and 4, through slits 60 are formed in the flat support plate 51 being corresponded to the fixing portions of the flat support plate 51. The through slits 60 are so formed as to surround parts of the regions surrounding the corresponding fixing portions. In this embodiment, the through slits 60 are formed for the corresponding fixing portions of the flat support plate 51 so as to be continuous over both side regions of the flat support plate 51 in the lengthwise direction and over the region on the side of the first tilted flat plate 52. If described in further detail, each through slit 60 comprises through slits 60*a* formed for the corresponding fixing portion of the flat support plate 51 extending in the direction of width in parallel with each other maintaining a distance in the lengthwise direction and at right angles with the lengthwise direction in both side regions in the lengthwise direction of the flat support plate 51, and a through slit 60*b* formed for the corresponding fixing portion of the flat support plate 51 extending in the lengthwise direction along the first tilted flat plate 52 in the region on the side of the first tilted flat plate 52 between the ends of the through slit 60*a* on the side of the first tilted flat plate 52. The through slits 60 that are shown are nearly in the shape of a channel.

Referring to FIGS. 1 to 4, the thus constituted separation member 8 is detachably false-mounted on the side frame 12C on the downstream of the upper coupling plate member 12 from the downstream side. That is, the to-be-engaged tongue pieces 54 formed at both ends of the separation member 8 are inserted in the corresponding elongated engaging holes 40 of the side frame 12C of the upper coupling plate member 12 in a detachable manner, and the to-be-engaged tongue piece 55 formed at the central portion of the flat support plate 51 is inserted in the corresponding engaging hole 42 in the side frame 12C of the upper coupling plate member 12 in a detachable manner. Therefore, the separation member 8 is false-mounted in a state where the flat support plate 51 is overlapped on the flat outer surface of the side frame 12C of the upper coupling plate member 12 which is facing in the downstream direction, unless it is pulled in the downstream direction from the side frame 12C of the upper coupling plate member 12. The sizes between the to-be-engaged tongue pieces 54 and the corresponding elongated engaging holes 40 in the up-and-down direction are so determined that the to-be-engaged tongue pieces 54 can be slightly moved in the up-and-down direction relative to the corresponding elongated engaging holes 40 in a state where the to-be-engaged tongue pieces 54 of the separation member 8 are inserted in the corresponding elongated engaging holes 40. The through holes 56 in the flat support plate 51 are positioned substantially in concentric with the corresponding internally threaded holes 44 of the side frame 12C. The diameters of the through holes 56 are greater than the diameters of the corresponding internally threaded holes 44.

The flat support plate 51 of the separation member 8 is detachably fixed to the side frame 12C by fastening means at the plurality of fixing portions (two fixing portions in the embodiment) provided for the support flat plate 51 and the side frame 12C that are brought in match with each other or, in this embodiment, by using screws 70 which are the fastening members in a state where the flat support plate 51 is overlapped on the outer surface of the side frame 12C of the upper coupling plate member 12. That is, in a state where the flat support plate 51 is overlapped on the outer surface of the side frame 12C, the separation member 8 is fastened thereto by using screws 70 through the mounting holes 56 in the flat support plate 51 of the separation member 8 and through the corresponding internally threaded holes 44 in the side frame 12C of the upper coupling plate member 12 (see FIGS. 1 and 2). In a state where the separation member 8 is fixed to the side frame 12C, the ends of the positioning protuberances 53A are brought into contact with the outer peripheral surfaces of the corresponding bearing members 28. The end of the separation portion 53B is positioned maintaining a predetermined gap with respect to the outer peripheral surface of the thermally fixing roller 4. That is, this constitution contributes to reliably preventing the gap between the end of the separation portion 53B and the outer peripheral surface of the thermally fixing roller 4 from becoming smaller than a predetermined gap and to maintaining the above gap highly precisely.

The end of the separation portion 53B is positioned maintaining a gap relative to the outer peripheral surface of the thermally fixing roller 4. Therefore, the outer peripheral surface (elastic layer) of the thermally fixing roller is not worn out or scratched. As a result, the life of the fixing device can be maintained as desired. This, further, overcomes the problem of renewing the fixing device at every regular maintenance of the image-forming machine.

When the pressing rotary means to be brought into pressed contact with the thermally fixing roller is constituted by the pressing belt mechanism 6, the biting amount of the support roller 30 on the downstream side into the outer peripheral surface of the thermally fixing roller is selected to be relatively great, so that the elastic layer constituting the outer peripheral surface of the thermally fixing roller is greatly depressed to enhance the separation of the paper (separation from the outer peripheral surface of the thermally fixing roller). As a result, the end of the paper is separated away to some extent from the outer peripheral surface of the thermally fixing roller 4 before it arrives at the gap between the end of the separation portion 53B and the outer peripheral surface of the thermally fixing roller 4. Therefore, despite the end of the separation portion 53B is positioned maintaining a gap relative to the outer peripheral surface of the thermally fixing roller 4, the paper is not caught up through the gap provided the gap is set to be smaller the distance for separation. Even when the pressing rotary means to be pressed onto the thermally fixing roller is constituted by the pressing roller, the biting amount of the pressing roller into the outer peripheral surface of the thermally fixing roller is selected to be relatively great, so that the elastic layer constituting the outer peripheral surface of the thermally fixing roller is greatly depressed to enhance the separation of the paper to accomplish the same effect as the one described above.

In the above fixing device, through slits 60 are formed in the flat support plate 51 of the separation member 8 being corresponded to the fixing portions, the through slits 60 surrounding parts of the regions that are surrounding the corresponding fixing portions. Due to this constitution, the separation member 8 can be easily deflected (or, in other words, can be elastically deformed with ease) relative to the fixing portions in a direction to separate away from the fixing portions (in a direction to separate away from the outer surface of the side frame 12C nearly at right angles thereto) On the other hand, a bending portion extending straight at a predetermined angle is formed between the first tilted flat plate 52 and the second tilted flat plate 53. Due to the rigidity of the bending portion, the degree of straightness is little affected at the end of the separation portion 53B of the second tilted flat plate 53. As a result, when the ends of the positioning protuberances 53A of the separation member 8 are brought into contact with the outer peripheral surfaces of the corresponding bearing members 28 and the first and second tilted flat plates 52 and 53 of the separation member 8 receive the reaction, the separation member 8 is such that the separation portion 53B of the second tilted flat plate 53 maintains the same shape of the flat plate as that of when it was produced first. Namely, the separation member 8 deflects with respect to the fixing portions while the separation portion 53B is in a state of maintaining straightness of when it was produced first. Accordingly, the predetermined gap is uniformly maintained on the outer peripheral surface of the thermally fixing roller 4 over the whole region in the axial direction. The reaction stems from dimensional tolerances of the separation member 8, frame 2 and thermally fixing roller 4, and from errors in the assembling.

When the through slits 60 are formed being corresponded to the fixing portions continuously over both side regions of the flat support plate 51 in the lengthwise direction and over the region on the side of the first tilted flat plate 52, the separation member 8 easily deflects relative to the fixing portions contributing to maintaining the gap as desired.

The separation member 8 that is made of a spring steel plate having a thickness that is equal to or less than 1.0 mm deflects easily relative to the fixing portions, and the gap can be maintained as desired.

In the above embodiment, the coupling means includes the metallic upper coupling plate member 12 which extends straight between the upper regions of the side plates 10 in the embodiment and couples the upper regions together, and the side frame 12C serves as a portion of the upper coupling plate member 12.

Figure 6:
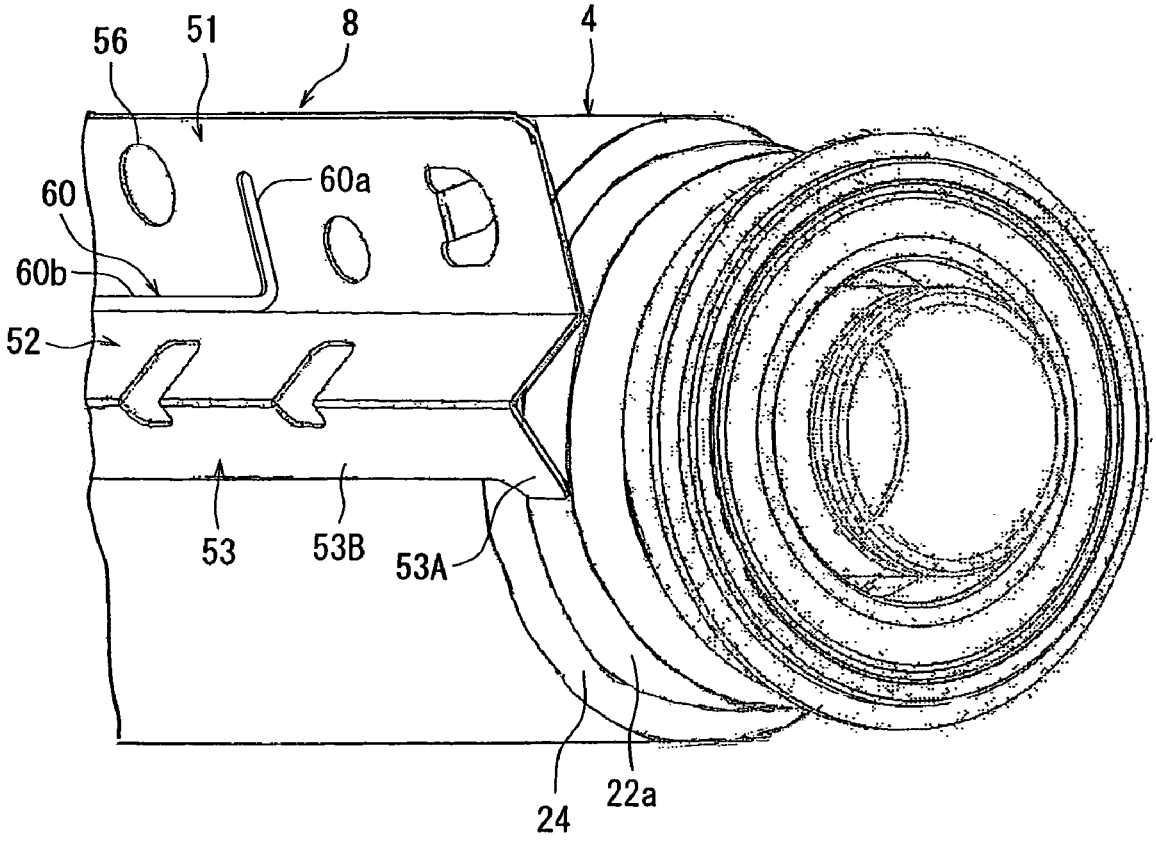
FIG. 6 is a perspective view illustrating major portions of another embodiment of the fixing device constituted according to the present invention, and corresponds to FIG. 5.

In the above embodiment, the positioning means are made of bearing members 28 for supporting the thermally fixing roller 4 so as to rotate relative to the side plates 10. In another embodiment, the positioning means are made of positioning portions disposed on the thermally fixing roller 4 integrally therewith. Referring, for example, to FIG. 6, both ends of the cylindrical main body 22 of the thermally fixing roller 4 are extending outward in the axial direction, whereby the outer peripheral surfaces 22*a* of the cylindrical main body 22 where the elastic layer 24 is not existing are exposed at both ends of the thermally fixing roller. The outer peripheral surfaces 22*a* of the cylindrical main body 22 can be easily utilized as the positioning portions.

In the above embodiment, the separation member 8 has two fixing portions for the side frame 12C. In another embodiment, however, the separation member 8 has three or more fixing portions. As the fixing means, there are used screws 70 which are the fastening members (externally threaded members such as bolts) to which only, however, the invention is in no way limited. For example, there can be contrived a constitution for overlapping a cover member (not shown) so as to cover the outer surface of the flat support plate 51 of the separation member and fixing it thereto (to detachably cover the outer surface so that a high-temperature portion of the fixing device will not be exposed at the time of handling the jamming). In this case, there can be contrived an embodiment in which the separating member is fastened to the side frame 12C at, for example, two fixing portions by using fastening members, and pins integrally arranged in the cover member are inserted in the through holes formed in the side frame 12C and in the flat support plate 51 of the separation member 8 at another fixing portion, and the fixing portion is pushed and fixed by a portion of the cover member. In this embodiment, it is desired to form the through slits 60 which are corresponded to the through holes in which the pins are inserted in the flat support plate 51 in the same manner as that of the embodiment described above to accomplish easy deflection.

I claim:

1. A fixing device comprising a pair of side walls, coupling means extending between the side walls, a thermally fixing roller rotatably supported between the side walls on the inside of the coupling means, pressing rotary means pressed onto the thermally fixing roller, and a separation member for separating paper from the outer peripheral surface of the thermally fixing roller; wherein positioning means are arranged at both end regions of the thermally fixing roller, the positioning means having circular outer peripheral surfaces concentric with the thermally fixing roller;

the coupling means extends straight between the side walls, and includes a side frame having a flat outer surface;

the separation member includes a strip-like flat support plate extending straight in the lengthwise direction maintaining a predetermined width, a first tilted flat plate bent from one side of the flat support plate in the direction of width and extending straight by a predetermined length, and a second tilted flat plate bent to the opposite side from the end of the first tilted flat plate and extending straight, which are made of a piece of elastic metal plate, wherein both end regions of the second tilted flat plate in the lengthwise direction form positioning protuberances extending by the same length, and an intermediate region between the two end regions forms a separation portion extending by a predetermined length which is shorter than the positioning protuberances; and the flat support plate of the separation member is fixed to the side frame by fixing means at a plurality of fixing portions provided on the flat support plate and on the side frame, which are brought in match with each other in a state where the flat support plate is overlapped on the outer surface of the side frame of the coupling means, and ends of the positioning protuberances are brought into contact with the outer peripheral surfaces of the corresponding positioning means in a state where the separation member is fixed to the side frame, so that the end of the separation portion is positioned maintaining a predetermined gap with respect to the outer peripheral surface of the thermally fixing roller.

2. A fixing device according to claim 1, wherein the flat support plate of the separation member has through slits formed therein being corresponded to the fixing portions, the through slits surrounding part of the regions that are surrounding the corresponding fixing portions.

3. A fixing device according to claim 2, wherein the through slits are formed for the corresponding fixing portions so as to be continuous over both side regions of the flat support plate in the lengthwise direction and over the region on the side of the first tilted flat plate.

4. A fixing device according to claim 3, wherein internally threaded holes are formed in the fixing portions in the side frame of the coupling means, mounting holes are formed in the fixing portions of the flat support plate of the separation member, the fixing means are made of fastening members, and the separation member is detachably fixed to the side frame of the coupling means by being fastened thereto by the fastening members through the mounting holes in the flat support plate of the separation member and through the internally threaded holes in the side frame of the coupling means, that are brought in match with each other in a state where the flat support plate is overlapped on the outer surface of the side frame.

5. A fixing device according to claim 1, wherein the separation member is made of a spring steel plate having a thickness equal to or less than 1.0 mm.

6. A fixing device according to claim 1, wherein the coupling means includes a metallic upper coupling plate member which extends straight between upper regions of the side walls and couples the upper regions together, and the side frame serves as a portion of the upper coupling plate member.

7. A fixing device according to claim 1, wherein the positioning means are made of bearing members for rotatably supporting the thermally fixing roller on the side walls or are made of positioning portions disposed on the thermally fixing roller integrally therewith.

* * * * *